US007140077B1

(12) United States Patent
Parsons

(10) Patent No.: US 7,140,077 B1
(45) Date of Patent: Nov. 28, 2006

(54) PULL DEVICE FOR STRAP RESTRAINT

(75) Inventor: Kevin L. Parsons, Appleton, WI (US)

(73) Assignee: Armament Systems & Procedures, Inc., Appleton, WI (US)

( * ) Notice: Subject to any disclaimer, the term of this patent is extended or adjusted under 35 U.S.C. 154(b) by 106 days.

(21) Appl. No.: 10/854,129

(22) Filed: May 26, 2004

(51) Int. Cl.
*A44B 11/20* (2006.01)
*A45F 5/00* (2006.01)

(52) U.S. Cl. ..... 24/16 PB; 294/158

(58) Field of Classification Search ..... 24/265 AI, 24/265 H, 370, 382, 429, 182; 16/420, 419, 16/446; 294/160, 26, 159, 158; 383/26, 383/22, 23, 13
See application file for complete search history.

(56) References Cited

U.S. PATENT DOCUMENTS 2,620,955 A * 12/1952 Elder ..... 294/166
3,158,284 A * 11/1964 Henchert et al. ..... 220/752
D219,111 S * 11/1970 Moen ..... D8/372
5,193,254 A * 3/1993 Geisinger ..... 24/484
5,303,859 A * 4/1994 Jenkin ..... 224/149
5,487,581 A * 1/1996 Carmo et al. ..... 294/137
6,247,739 B1 * 6/2001 Lyon ..... 294/159
6,698,067 B1 * 3/2004 Strange et al. ..... 24/16 PB

* cited by examiner

*Primary Examiner*—Robert J. Sandy
(74) *Attorney, Agent, or Firm*—Welsh & Katz, Ltd.

(57) ABSTRACT

The pull device comprises a stem or body, a pull structure at one of the stem or body; an end bar or crossbar at the other end of the body or stem and extending transversely of the stem or body for extending through at least one hole in at least one end of a free tip end portion of a strap of a restraint for facilitating pulling of the strap through a locking box of the restraint in a single pull.

The strap restraint comprises at least one strap having a free tip end portion and the strap having a hole in the strap adjacent an end of the free tip end portion of the strap for receiving a bar of a pull device.

43 Claims, 8 Drawing Sheets

PULL DEVICE FOR STRAP RESTRAINT

BACKGROUND OF THE INVENTION

1. Field of the Invention

The present invention relates to a pull device for pulling the free tip end portion of at least one strap of a strap restraint which may be received through a locking box and relates to a strap restraint having structure, namely a hole at and adjacent an end of a free tip end portion of the strap for facilitating engagement of the pull device with the free tip end portion of the at least one strap. The strap may be foldable and is placed over a wrist of a person being restrained. Preferably two straps are used and are jointly pulled to fasten and lock the restraints around the wrists of the person being restrained. Also, the pull device can be removed from the one or two straps for reuse after it's initial use.

2. Description of the Related Art

Heretofore, foldable strap restraints have been proposed for use in restraining an individual being apprehended by police and military personnel.

Examples of previously proposed foldable strap restraints are disclosed in the following U.S. patents:

| U.S. Pat. No. | PATENTEE |
|---|---|
| 5,669,110 | Parsons |
| 5,802,675 | Parsons |
| 6,101,682 | Parsons |

As disclosed in the Parsons U.S. Pat. No. 6,101,682, two separate flexible straps are provided each having a free tip end portion passing through a locking box. Detents are provided in each locking box and are arranged to resiliently engage a saw-tooth ribbed surface on each strap to retain the strap once it has been pulled through a central opening of the locking box to prevent the straps from being withdrawn once the free tip end portions are pulled outwardly from the locking box.

While these restraints have been well received by the military and law enforcement communities, some difficulty has been incurred in gripping the free tip end portions and pulling them through the locking box. In this respect, the ratcheting arrangement between the detent and or detents of the saw-tooth ribbed surface creates a significant amount of friction, which impedes movement of the straps. As a result, the free tip end portions of the straps are not always pulled equally such that the user often has to pull one strap tip at a time. Further note that it is easier to hook and pull the free tip end portions of the straps than it is to pinch and pull the free tip end portions. Still further the user typically is wearing gloves which makes it even harder to pinch and pull the free tip end portions.

Additionally, the locking box with the foldable strap restraints are carried in a pocket in a pair of pants or in a jacket or may be mounted with a clip on a belt worn around the waist. Typically a number of pairs of restraints are carried on a carbineer attached to tactical holding of or on a uniform. While such positioning of the foldable strap restraints and an associated locking box has proved satisfactory there are times when the user encounters difficulty in retrieving the foldable strap restraints from their stored position on his or her belt or clothing when the locking box snags on the user's clothing.

As will be described in greater detail hereinafter, the strap restraints and the pull device of the present invention provide cooperating structure for providing quick retrieval of the strap restraints and facilitate even and/or equal pulling on the free tip end portion of the strap or straps as well as simple retrieval of the strap restraints.

BRIEF SUMMARY OF THE INVENTION

According to one of the teachings of the present invention there is provided a pull device comprising a stem or body, a pull structure at one end of the stem or body; an end bar or crossbar at the other end of the body or stem and extending transversely of the stem or body for extending through at least one hole in at least one end of a free tip end portion of a strap of a restraint for facilitating pulling of the strap to a locked position about a person's wrist a single pull.

According to another teaching of the present invention there is provided in a strap restraint comprising at least one strap having a free tip end portion which is pulled tolock the strap about a person's wrist, a hole adjacent the end of the free tip end portion for receiving a bar of a pull device.

According to a further teaching of the present invention there is provided the combination of a strap restraint comprising at least one strap having a free tip end portion having a hole in the free tip end portion adjacent an end of the free tip end portion and a pull device having an end or cross bar which is received in the hole for pulling the strap.

DETAILED DESCRIPTION OF THE INVENTION

Figure 1:
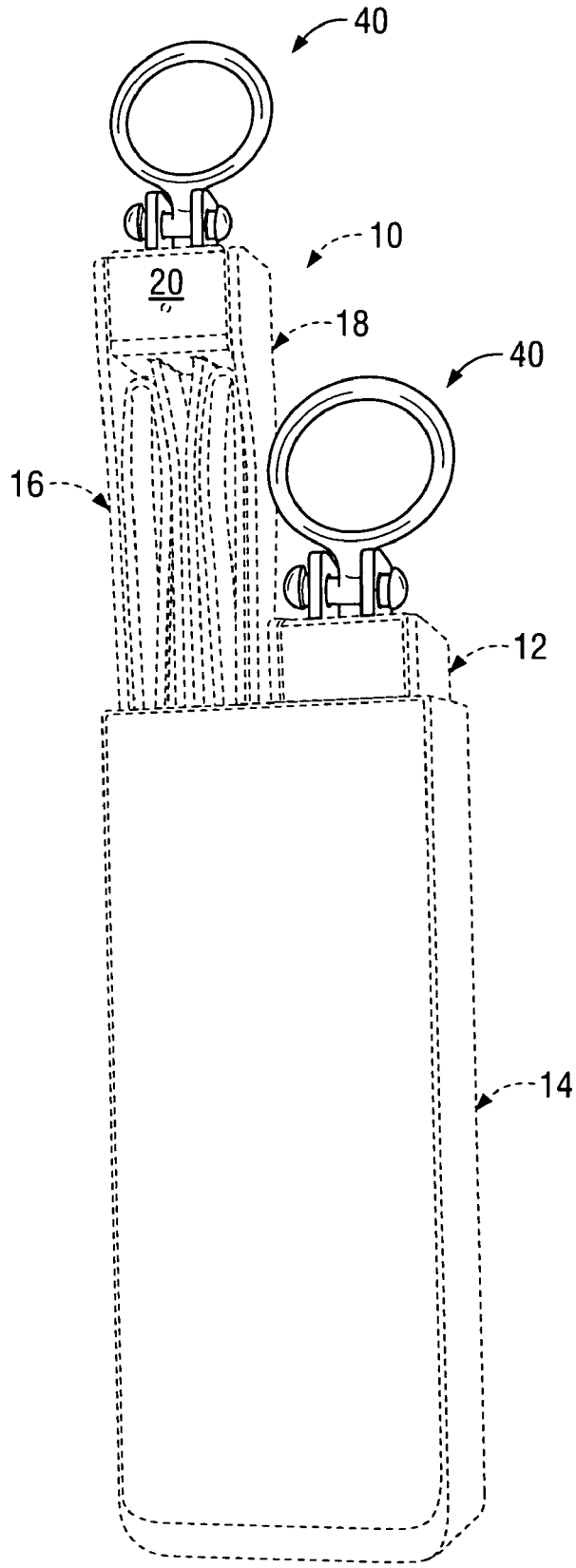
FIG. 1 is a plan view of two pull devices constructed according to one of the teachings of the present inventions mounted to the free tip end portions of a pair of foldable strap restraints which are received in a box shaped holder.
Figure 2:
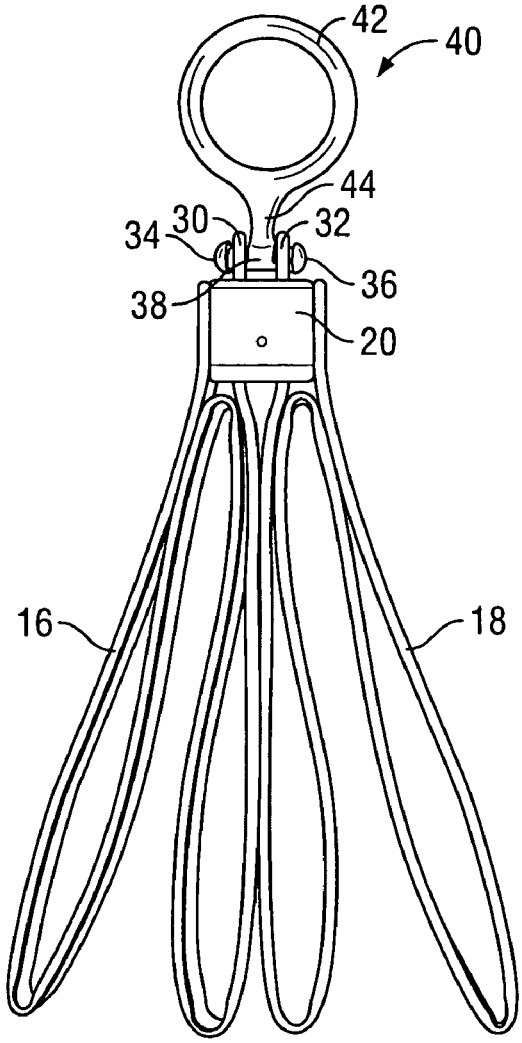
FIG. 2 is a side elevational view of a pair of foldable strap restraints showing the free tip end portions extending through the locking box of the restraints and having the pull device of the present invention mounted to a pair of free tip end portion tips.

Referring now to FIG. 1, there is illustrated therein, in greater detail and partially in phantom, two strap restraints 10 and 12 each including a conventional box holder 14 for two foldable straps 16 and 18, each strap being received in and through a locking box 20.

Figure 3:
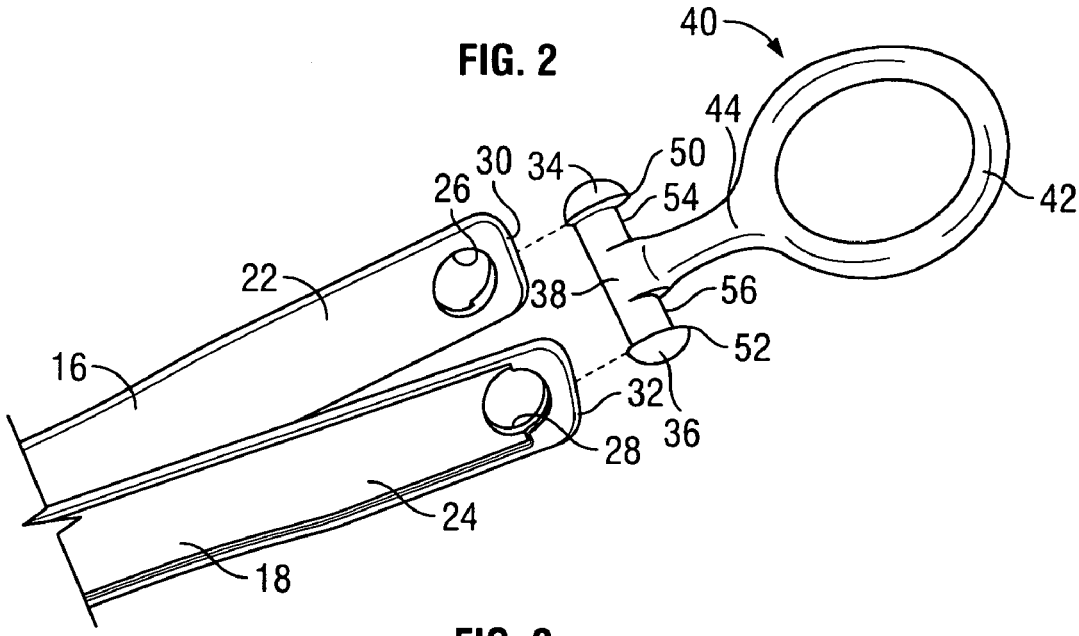
FIG. 3 is a plan view of the foldable strap restraints placed around the wrists of a person being apprehended and shows the hand of a user gripping the pull device and pulling the foldable strap restraints through the locking box to pull the strap restraints around the wrists of a person being restrained.

According to one of the teachings of the present invention and as best shown in FIG. 3, free tip end portions 22 and 24 of the straps 16 and 18 of each foldable strap restraint 10 and 12 is provided with a hole 26 or 28 (FIG. 3) close to the outer end 30 or 32 of each free tip end portion 22 or 24 for receiving one end 34 or 36 of a strap engaging end bar 38 of a pull device 40 constructed according to the teachings of the present invention.

Figure 4:
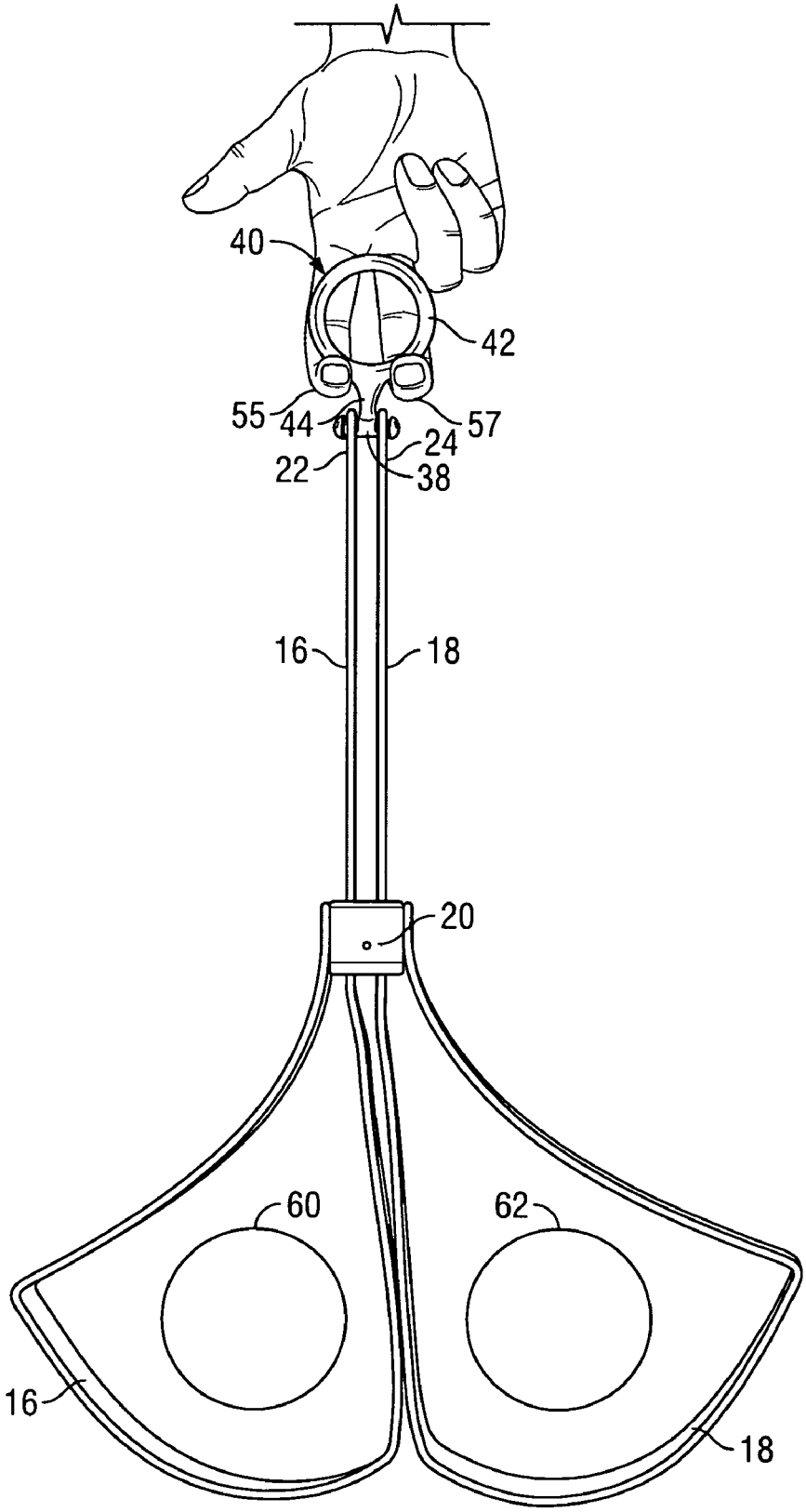
FIG. 4 is a perspective view of the free tip end portions with holes therein at the ends thereof and a strap engaging end bar of a pull device about to be inserted in the holes.
Figure 5:
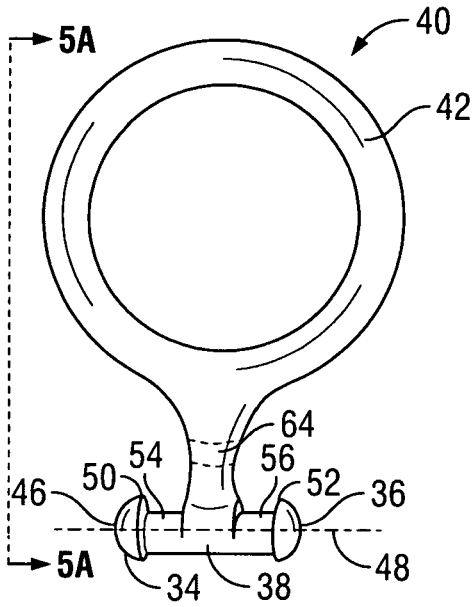
FIG. 5 is a perspective view of the pull device shown in FIG. 3 and shows a living hinge in a stem between the pull bar and a ring of the pull device for facilitating use of the device in hanging a pair of restraints.

As shown in FIGS. 4 and 5, the pull device 40 includes the strap engaging end bar 38, a ring or ring portion 42 and a stem or stem portion 44 connected between the ring or ring portion 42 and the end bar 38.

The end bar 38 has rounded, partially semi-spherical ends 34 and 36 which are generally semi-spherical in shape. The center 46 of the sphere is offset from a center axis 48 of the end bar 38 so that the end bar 38 has a locking lip 50 or 52 on the outer periphery of each semi-spherical end 34, 36 on a side of the end bar 38 closest to the ring or ring portion 42. Then the end bar 38 has a collar 54 or 56 formed thereon, larger in diameter than the end bar 38 but smaller in diameter than the adjacent semi-cylindrical end 34 or 36. This construction facilitates insertion of the rounded semi-spherical ends 34 and 36 through each of the end holes 26 and 28 of the free tip end portions 22 and 24 and seating of the straps 16 and 18 on the respective collars 52 and 54.

As shown in FIG. 4, the free tip end portions 22 and 24 are spread apart and the end bar 38 is pushed between them until the rounded sphere ends 34 and 36 are adjacent each of the holes 26 and 28. Then the outer ends 30 and 32 of the free tip end portions 22 and 24 of the straps 16 and 18 are pushed over or snap fit over the rounded semi-spherical ends 34 and 36 to catch the outer ends 30 and 32 of the free tip end portions 22 and 24 on the collars 54 and 56 with the locking lips 50 and 52 on each rounded, partially semi-spherical end 34 and 36 opposite the surface 50 on the end bar 38 latching the outer ends 30 and 32 of the free tip end portions 22 and 24 on the collars 54 and 56 on the end bar 38 inside of the rounded semi-spherical ends 34, 36.

Note, that the spacing between slots (not shown) in the locking box 20 relative to the length of the end bar 38 is such that when the free tip end portions 22 and 24 are close to the locking box 20, the distance between the outer ends 30 and 32 is less than the length of the end bar 38 thereby establishing the "snap fit" of the rounded ends 34 and 36 of the end bar 38 into the holes 26 and 28 adjacent the ends 30 and 32 of the free tip end portions 22 and 24.

After the end bar 38 is mounted to the ends 30 and 32 of the free tip end portions 22 and 24 of the straps 16 and 18, a user of the pull device 40 will grip the ring or ring portion 42 on the outside thereof with an index finger 55 and middle finger 57, as shown in FIG. 4, and pull the pull device 40 to pull the straps 16 and 18 through the locking box 20 and around the wrists 60 and 62 of a person being restrained.

Figure 5A:
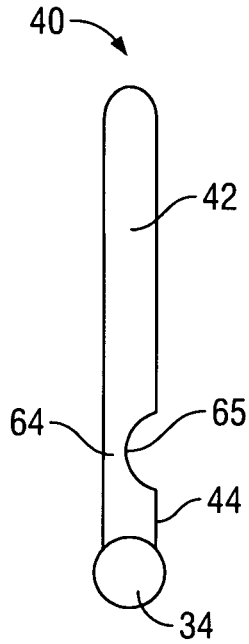
FIG. 5A is an elevational side view of the pull device shown in FIG. 5 and shows a living hinge formed in the stem or stem portion of the pull device.
Figure 12:
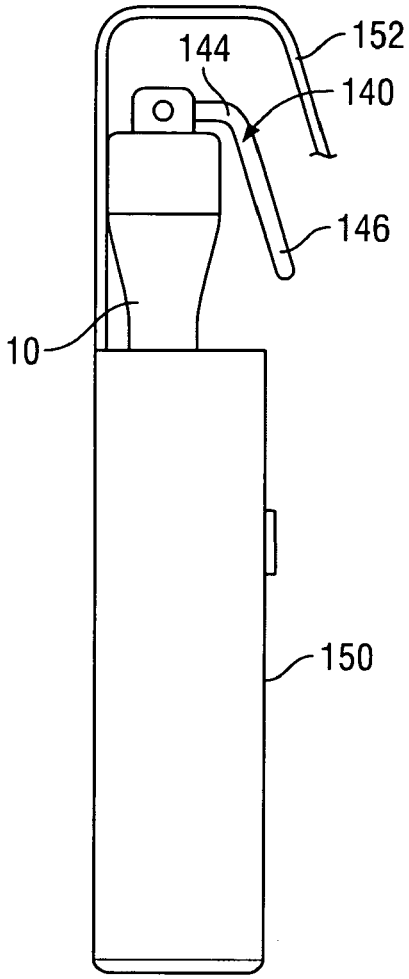
FIG. 12 is a side elevational view of the upper portion of the pouch shown in FIG. 11 and shows a pull device folded over about a flexible part of a stem of the pull device so that a ring shaped loop of the pull device extends generally parallel to the pouch.
Figure 13:
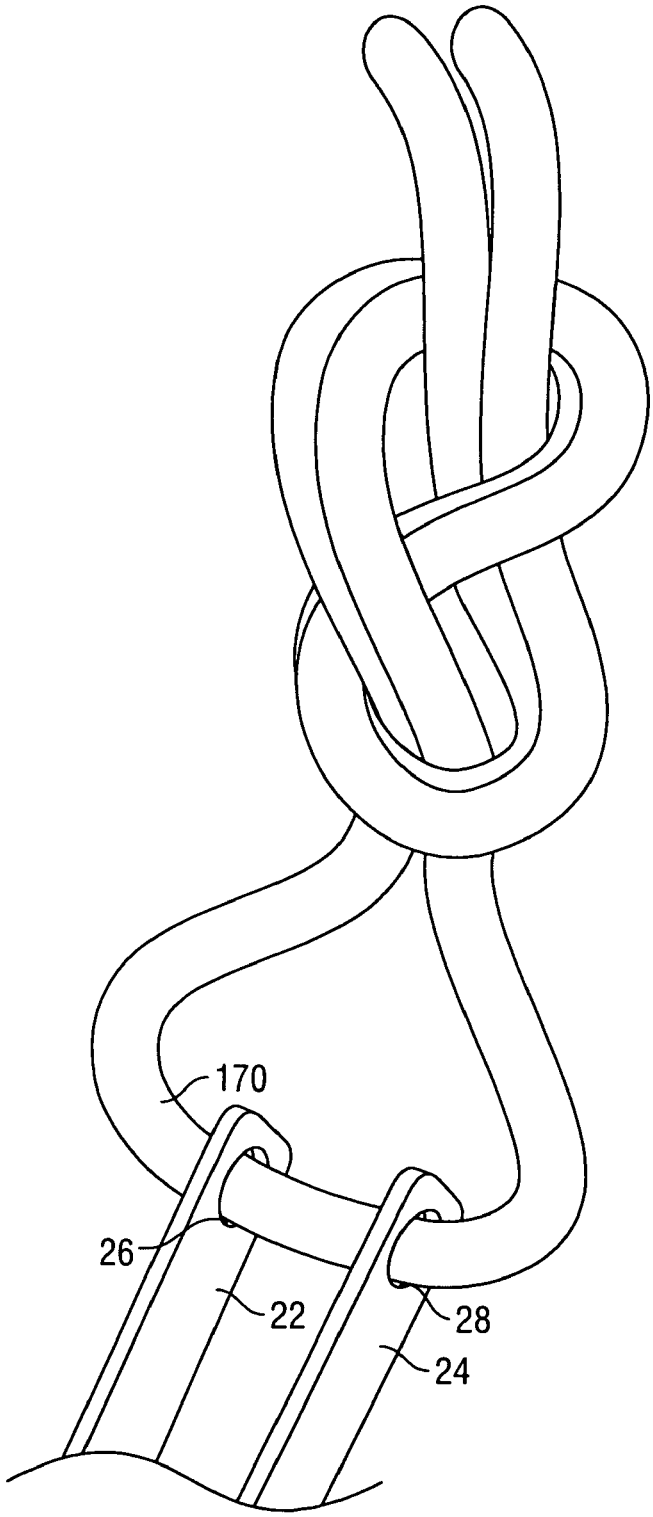
FIG. 13 is a perspective view of a cord extending through end holes in the free tip end portions of two straps of a strap restraint and then tied in a figure eight.

As best shown in FIG. 5A, the stem or stem portion 44 can have a thinner, reduced thickness or weakened portion 64 formed by a cut away 65 defining a living hinge 64 to permit folding of the ring or ring portion 42 perpendicular to the stem or stem portion 44. This feature is important for releasably mounting the ring or ring portion 42 transversely to a uniform and it is desirable then to position the restraint 10 parallel to the uniform. Also, as shown in FIG. 12, the pull device 40 with the cutaway 65 can be folded parallel to a carrying pouch for carrying several strap restraints 10 with pull devise 40 attached in the pouch mounted on a belt.

Figure 6:
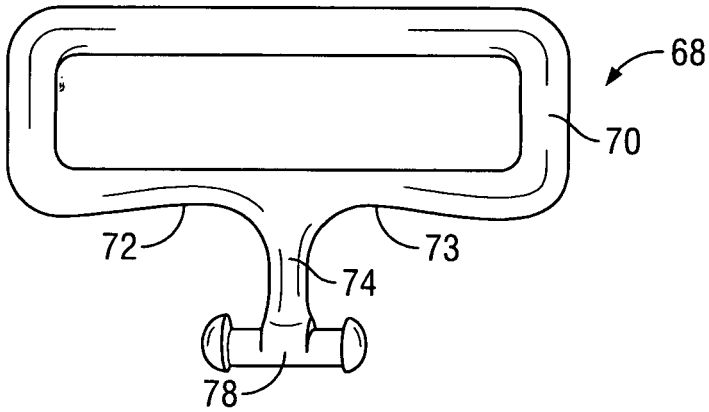
FIG. 6 is a perspective view of a modified pull device having a generally rectangular ring that provides curved surface areas for gripping by the forefinger and middle finger for pulling the pull device.

FIG. 6 shows a modified pull device 68 where a ring or ring portion 70 of the device 68 is a generally rectangular ring or ring portion 70 having curved undersurfaces 72 and 73 adjacent a stem or stem portion 74 and opposite a strap engaging end bar 78. The curved surfaces 72 and 73 facilitate engagement of the generally rectangular ring or ring portion 70 with the index and middle finger.

Figure 7:
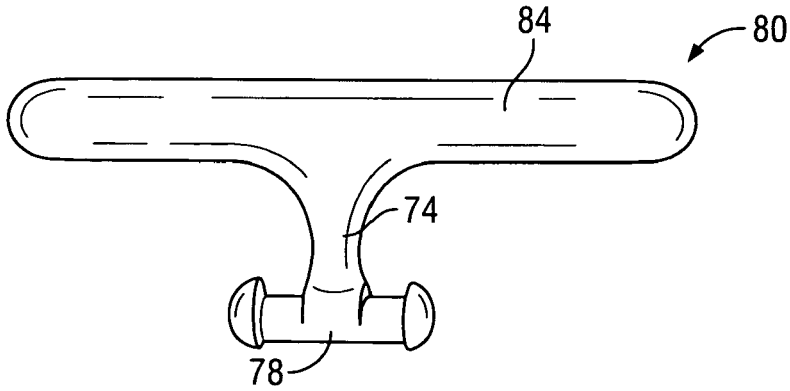
FIG. 7 is a perspective view of another modified pull device comprising a pull bar, a stem and a strap engaging end bar.

In FIG. 7 is illustrated a further embodiment of a pull device 80 constructed according to the teachings of the present invention. Here a pull bar 84 is provided in place of the ring or ring portion 42 shown in FIG. 5. The pull bar 84, however, suffers from the disadvantage that it does not facilitate mounting of the pull device 80 and foldable strap restraints connected thereto to a loop on an article of clothing or uniform of a user as does the ring or ring portion 42 of the device 40 shown in FIG. 5 or the rectangular ring 70 of the device 68 shown in FIG. 6.

Figure 8:
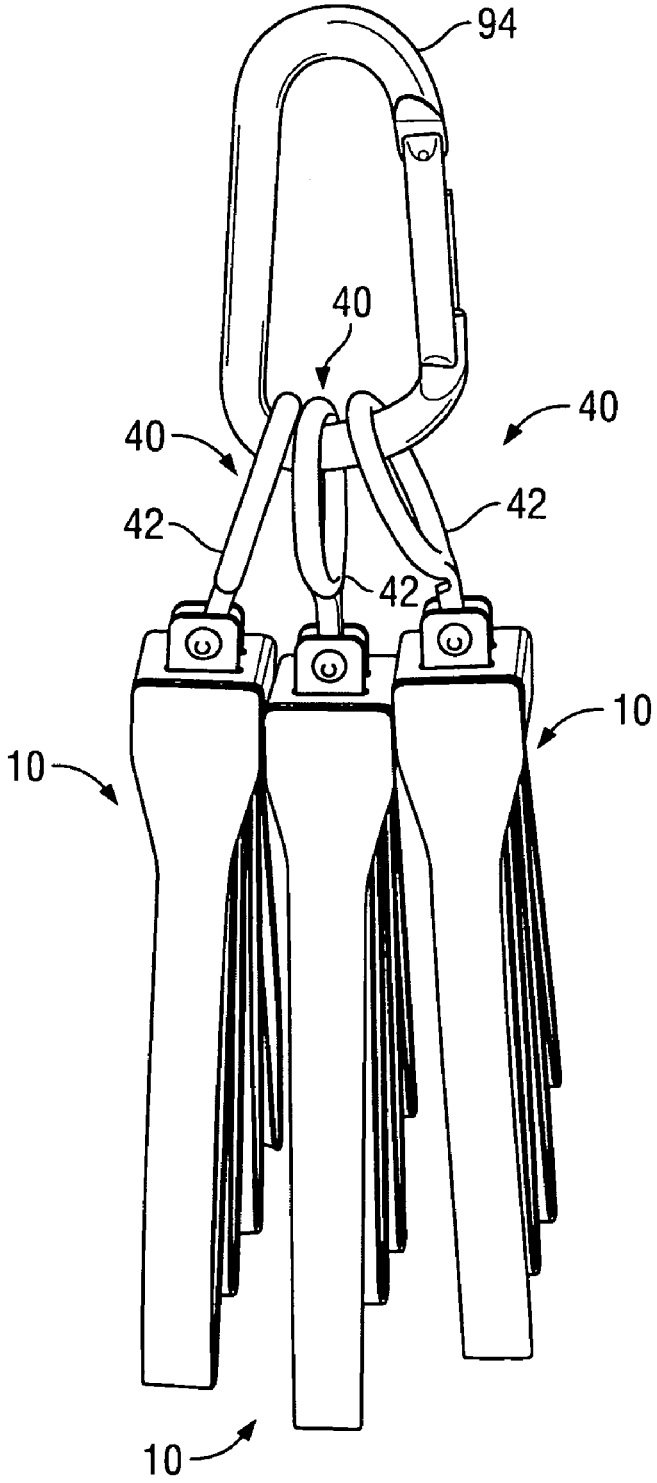
FIG. 8 is a perspective view of a carbineer mounting several pull devices connected to strap restraints.

Several pull devices 40 attached to strap restraints 10 are shown in FIG. 8 mounted via the ring shaped loops 42 on a carbineer 94 that can be attached easily to apparel worn by military personnel or law enforcement officers.

Figure 9:
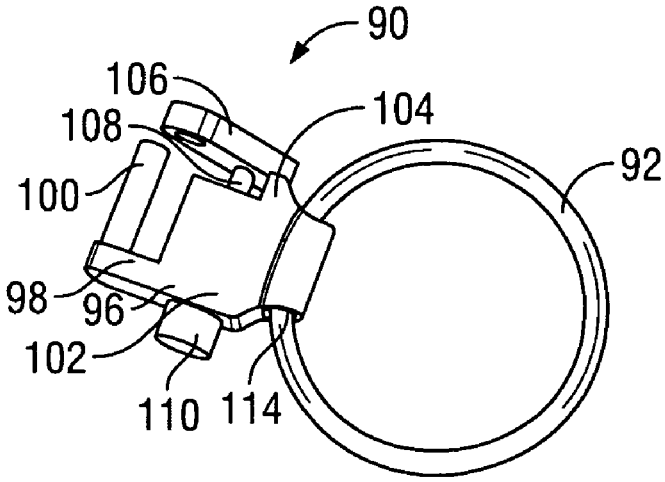
FIG. 9 is a perspective view of another modified pull device of the present invention including a ring mounted in a through bore in a body, a first arm on one side of the body and extending outwardly and having a crossbar extending transversely of the device for engaging a free tip end portion and a second, pivotal, spring-biased, locking arm on the other side of the body and shows the locking arm in an open position.
Figure 10:
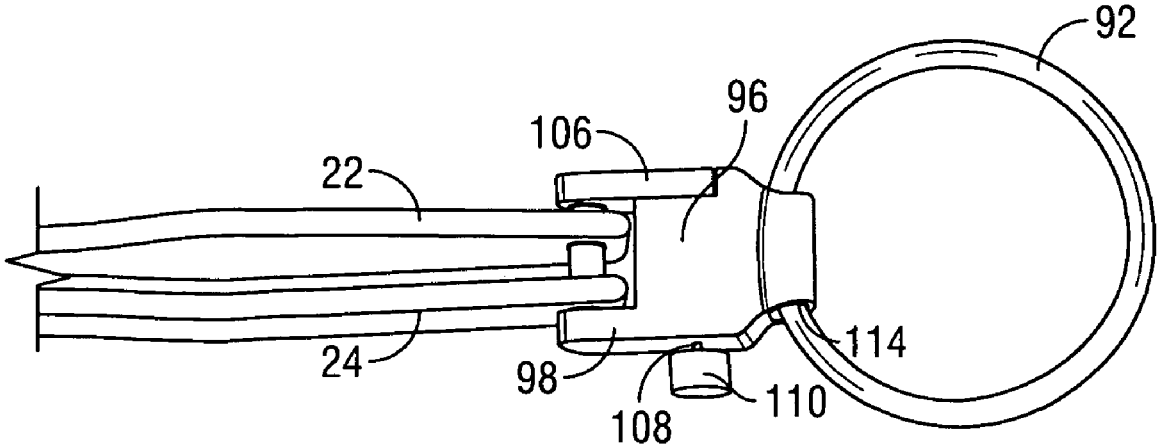
FIG. 10 is a perspective view of the device shown in FIG. 9 and shows the crossbar received through the end holes in the free tip end portions of a pair of foldable strap restraints and shows the locking arm moved to the locked position.

In FIG. 9 there is shown a further modified pull device 90 that includes a ring 92 which also can be mounted on the carbineer 94. The pull device 90 shown in FIGS. 9 and 10 includes not only the ring 92 but also a body 96 having a fixed arm 98 extending therefrom to a crossbar 100 on one side 102 of the body 96. On the other side 104 of the body 96 is a locking arm 106 mounted on a pin 108 which extends through the body 96 such that a knob 110 at the other end of the pin 108 can be moved toward the body 96 (as shown in FIG. 9) to release the locking arm 106 from the crossbar 100 and rotated as shown in FIG. 9. This allows the crossbar 100 to be inserted through one or two holes 26 and 28 adjacent the ends 30 and 32 of the free tip end portions 22 and 24 of the straps 16 and 18 and then locked in place when the knob is released, as shown in FIG. 10

The body 96 further has, at an end 112 opposite the crossbar 100 a bore 114 through which the ring 92 is received, thus allowing the body 96 to be rotated relative to the ring 92, e.g., at least ninety degrees.

Figure 11:
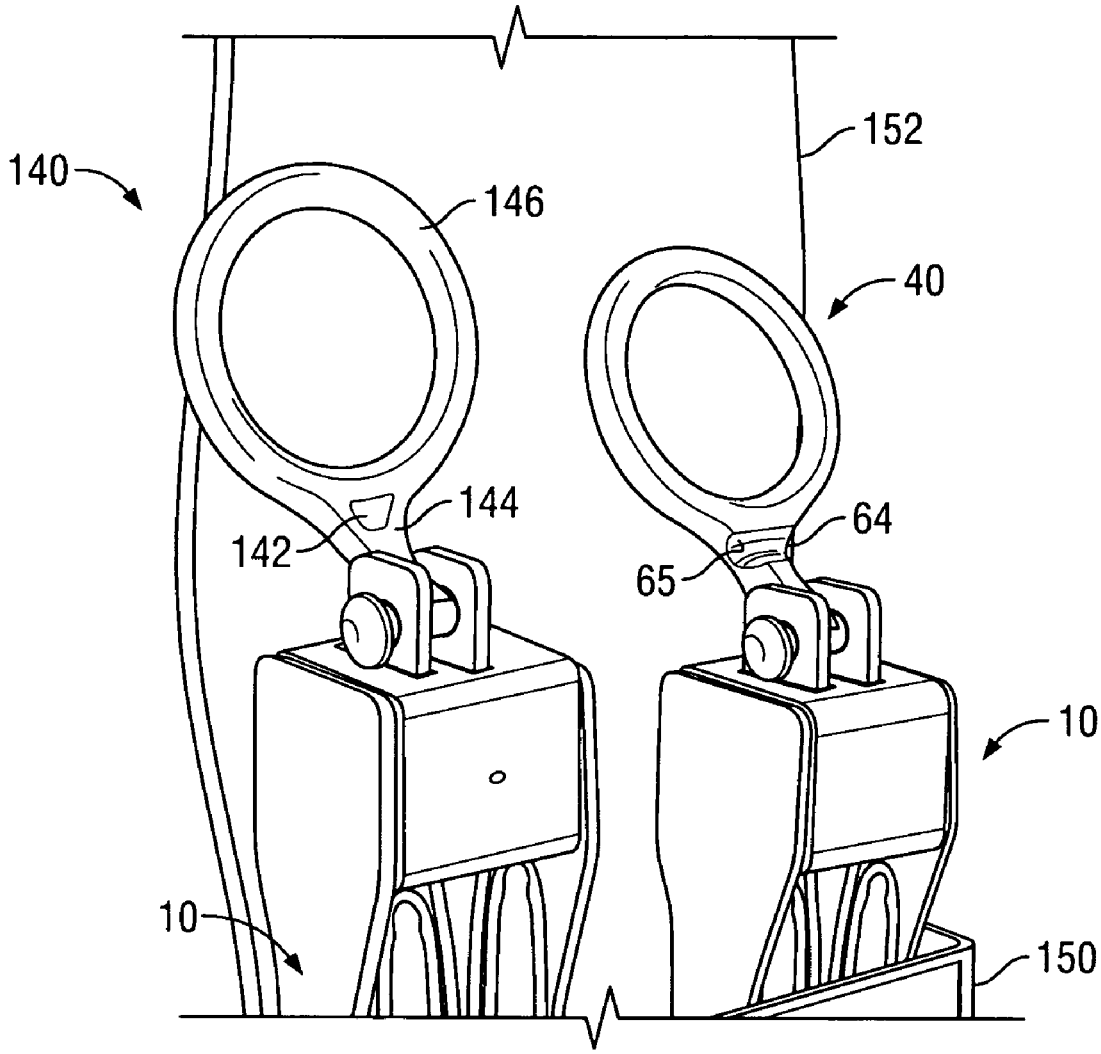
FIG. 11 is a perspective view of two strap restraints with pull devices attached that are received in a pouch which can be mounted on a belt.

In FIG. 11 there is illustrated a modified pull device 140 which is made of a pliable material and which has triangular indentations 142 in and on either side of a stem 144 thereof to facilitate folding over of the pull device 140 about the stem so that a ring 146 thereof can extend generally parallel to a strap restraint 10 to which it is attached as shown in FIG. 12. The strap restraint 10 is shown in a pouch 150 which has a cover flap 152 and which can be mounted on a belt. A second restraint 10 having a modified pull device 40 as shown in FIG. 5 is also shown received in the pouch 150.

FIG. 12 is a side elevational view of the upper portion of the pouch 150 shown in FIG. 11 and shows the pull devices folded 140 and 40 folded over about the flexible stem 144 or living hinge 64 so that the ring shaped loop 146 or 42 of the pull device 140 or 40 extends generally parallel to the pouch 150.

It will be appreciated that several pull devices such as the pull device 140 shown in FIG. 11, the pull device 90 shown in FIG. 8, the pull device 80 shown in FIG. 7, the pull device 68 shown in FIG. 6, the modified pull device 40 shown in FIGS. 5 and 5A and the pull device 40 shown in FIGS. 1–4 have been described herein which provide structure for engaging in end holes 26 and 28 and pull structure for pulling the ends 30 and 32 of the straps 16 and 18. Further It will be appreciated that the pull devices 40, 68, 90 and 140, including the ring or ring portion 42, 70, 92 or 146, not only provide structure for gripping the pull device 40, 68, 90 or 140 for pulling the free tip end portions 22 and 24 of the foldable straps 16 and 18 but also provide a simple (ring) structure for mounting the pull device or pull devices on a carbineer 94 or other loop attached to apparel worn by the user.

From the foregoing description it will be apparent that the pull devices 40, 68, 80, 90 and 140 of the present invention have a number of advantages, some of which have been described above and others of which are inherent in the present invention.

For example, the provision of holes 26 and 28 in the free tip end portions 22 and 24 adjacent the ends 30 and 32 each strap 16 and 18 permit an end bar or crossbar of a puling device 40, 68, 80 or 90 to engage one and preferably both free tip end portions 22, 24 of one or both of a pair of foldable straps 16 and 18 to facilitate pulling of the straps 16 and/or 18 through the locking box 20. The provision of end holes 26 and 28 adjacent the ends 30 and 32 of the free tip end portions 22 and 24 also facilitate use of the pull devices 40, 68, 80 and 90 to pull the straps 16 and 18 equally and evenly about the wrists 60 and 62 of a person being restrained.

Note that in place of the pull device 40, a wire, string key chain or a piece of cord 170, e.g., a piece of parachute cord used by the military, can be inserted through the holes 26 and 28 and tied in a FIG. 8 knot as shown in FIG. 133 for use as a pulling structure for the straps 22 and 24.

Note that the strap engaging end bar 38 with the snap-in ends 34 and 36 is constructed and sized to span between the ends 30 and 32 of the free tip end portions 22 and 24 of the separated strap ends 30 and 32. Further, when the straps 16 and 18 are pulled in to the locking box 20, the end bar being longer than the span enables the pull device 40 to be locked in place between the ends 30 and 32 of the straps 16 and 18. Also, both straps 16 and 18 can be pulled through a locking box with a single pull on the pulling device 40, 68, 80 or 90.

The rounded offset partially semi-spherical ends 34 and 36 forming the lips 50 and 52 of the end bar 38 and the collars 54 and 56 on the end bar 38, facilitate secure engagement of the ends 34 and 36 of the end bar 38 with the ends 30 and 32 of the free tip end portions 22 and 24 of the straps 16 and 18.

Also as noted above, the provision of a ring or ring portion 42, 70 or 92 facilitates mounting or carrying of the pull devices 40, 68 and 90 and sets of foldable strap restraints 10 and 12 connected thereto on a loop or carbineer 94 on the user's apparel.

The living hinge 64 or the ring 92 in bore 114 facilitate folding of the restraints 10 and 12 generally parallel to a persons body.

Note also that one can insert at least one finger through the ring 42, 70, 92 or 146 for pulling the pull device 40, 68, 90 or 140. However, it has been found empirically that a stronger grip on the pull device 40, 68, 90 or 140 is obtained by placing the index and middle fingers outside the ring or ring portion 42, 70, 92 or 140 as shown in FIG. 4.

Also, it will be understood that modifications can be made to the free tip end portions and the pulling devices of the present invention without departing from the teachings of the present invention. Accordingly, the scope of the present invention is only to be limited as necessitated by the accompanying claims.

I claim:

1. A strap restraint comprising a stem or body, a pull structure coupled to one end of said stem or body; an end bar or crossbar at the other end of said body or stem and a strap, said end bar or crossbar extending transversely of said stem or body through at least one hole in at least one end of a free tip end portion of the strap of the strap restraint for facilitating pulling of the strap to a locked position about a person's wrist.

2. The restraint of claim 1, wherein said pull structure is a closed loop.

3. The strap restraint of claim 2, wherein said closed loop is generally rectangular in shape with curved surfaces adjacent to said stem for facilitating gripping of said closed loop by the index and middle finger.

4. The strap restraint of claim 2, wherein said closed loop is generally circular or ring-shaped.

5. The strap restraint of claim 2, wherein said closed loop and said body or stem are constructed and arranged to permit pivotal movement of said ring-shaped loop relative to said body or stem.

6. The pull device strap restraint of claim 5, wherein said ring-shaped loop can be pivoted to at least approximately ninety degrees to said stem or body.

7. The strap restraint of claim 5, wherein said ring-shaped loop is a ring and said body has a transverse bore through which said ring extends to permit pivotal movement of said ring relative to said body.

8. The strap restraint of claim 1, wherein said pull structure is a pull bar extending transversely of said stem or body.

9. A pull device comprising a stem or body, a pull structure coupled to one end of said stem or body; an end bar or crossbar at the other end of said body or stem and extending transversely of said stem or body for extending through at least one hole in at least one end of a free tip end portion of a strap of a restraint for facilitating pulling of the strap to a locked position about a person's wrist, wherein said end bar or crossbar extends through two holes, each hole being in and at one end of a free tip end portion of a strap of a strap restraint.

10. The pull device of claim 9 for use with two straps each having a free tip end portion extending through a locking box of a strap restraint.

11. The pull device of claim 10, wherein said end bar has end portions extending transversely from opposite sides of said stem such that when said bar is inserted into said holes in and at the ends of the free tip end portions of the straps, said stem is located between the straps.

12. The pull device of claim 11, wherein each end of said end bar has a rounded end.

13. The pull device of claim 12, wherein each rounded end is generally, partially semi-spherical and has a center offset from an elongate axis of said end bar such that a locking lip is formed on a side of said end bar facing toward said pull structure and, on the other side of said end bar, the surface of said end bar is constructed and arranged to engage the strap.

14. The pull device of claim 13 wherein said end bar has a collar thereon at each end thereof, inwardly of, adjacent to and of smaller diameter than said adjacent rounded generally semi-spherically shaped end.

15. A pull device comprising a stem or body, a pull structure coupled to one end of said stem or body; an end bar or crossbar at the other end of said body or stem and extending transversely of said stem or body for extending through at least one hole in at least one end of a free tip end portion of a strap of a restraint for facilitating pulling of the strap to a locked position about a person's wrist, wherein said closed loop and said body or stem are constructed and arranged to permit pivotal movement of said ring-shaped loop relative to said body or stem, wherein said ring-shaped loop can be pivoted to at least approximately ninety degrees to said stem or body and wherein said stem has a living hinge to permit pivotal movement of said ring-shaped loop relative to said stem.

16. The pull device of claim 15 wherein said living hinge is formed by a cut away in said stem.

17. The pull device of claim 15 wherein said living hinge is established by making said stem of a pliable plastic material.

18. The pull device of claim 17 wherein the flexibility of said stem is enhanced by forming at least one indentation in said stem.

19. A strap restraint comprising: a pull device; a bar extending from the pull device and; at least one strap having a free tip end portion and said strap having a hole in said strap adjacent an end of said free tip end portion of said strap for receiving the bar of the pull device and wherein the pull device and bar are used to facilitate pulling the at least one strap of the restraint device to a locked position about a person's wrist.

20. In combination, a strap restraint comprising at least one strap having a free tip end portion having a hole in said strap adjacent an end of said free tip end portion and a pull device having a stem or body and an end bar at one end of said stem or body that is received in said hole and used to facilitate pulling the at least one strap of the strap restraint to a locked position about a person's wrist.

21. The combination of claim 20 wherein said strap restraint includes two straps and a locking box which is constructed with the distance between spaced openings in said locking box, each opening for receiving a free tip end portion therethrough, being less than the length of said end bar so that when said ends of said straps are pulled close to said locking box, said pull device is snap-fitted into said holes thereby to latch or lock said pull device on said strap ends.

22. The combination of claim 20, wherein said end bar has end portions extending transversely from opposite sides of said stem and said strap restraint includes two straps, such that, when said bar is inserted into said holes in and at said ends of said free tip end portions of said straps, said stem is located between said straps.

23. The combination of claim 22, wherein each end of said end bar has a rounded end.

24. The combination of claim 23, wherein said rounded end is generally, partially semi-spherical and has a center offset from an elongate axis of said end bar such that a locking lip is formed on a side of said end bar facing toward said pull structure and, on the other side of said end bar, the surface of said end bar is constructed and arranged to engage said strap.

25. The combination of claim 24 wherein said end bar has a collar thereon at each end thereof, inwardly of, adjacent to and of smaller diameter than said adjacent rounded generally semi-spherically shaped end.

26. The combination of claim 20, wherein said pull device includes pull structure in the form of a closed loop coupled to said stem or body.

27. The combination of claim 26, wherein said closed loop is generally rectangular in shape with curved surfaces adjacent to said stem for facilitating gripping of said closed loop by the index and middle finger.

28. The combination of claim 26, wherein said closed loop is generally circular or ring-shaped.

29. The combination of claim 26, wherein said closed loop and said body or stem are constructed and arranged to permit pivotal movement of said ring-shaped loop relative to said body or stem.

30. The combination of claim 29, wherein said ring-shaped loop can be pivoted to at least approximately ninety degrees to said stem or body.

31. The combination of claim 30, wherein said stem has a living hinge to permit pivotal movement of said ring-shaped loop relative to said stem.

32. The combination of claim 31 wherein said living hinge is formed by a cut away in said stem.

33. The combination of claim 31 wherein said living hinge is established by making said stem of a pliable plastic material.

34. The combination of claim 33 wherein the flexibility of said stem is enhanced by forming at least one indentation in said stem.

35. The combination of claim 30, wherein said ring-shaped loop is a ring and said body has a transverse bore through which said ring extends to permit pivotal movement of said ring relative to said body.

36. The combination of claim 20, wherein said pull device includes pull structure in the form of a pull bar extending transversely of and fixed to said stem or body.

37. A strap restraint comprising a stem or body, a pull structure coupled to one end of said stem or body; an end bar or crossbar at the other end of said body or stem and extending transversely of said stem or body; a strap where said end bar or crossbar extends through at least one hole in at least one end of a free tip end portion of the strap of the strap restraint for facilitating pulling of the strap to a locked position about a person's wrist by inserting the end bar or crossbar into the one hole at the end of the strap and pulling on said strap restraint, and an opening through said pull structure for allowing the strap restraint to be hung on an element inserted through the opening.

38. A strap restraint comprising a stem or body and an end bar or crossbar extending from said stem or body; a strap where said end bar or crossbar extends through at least one hole in at least one end of a free tip end portion of the strap of the strap restraint for facilitating pulling of the strap to a locked position about a person's wrist by inserting the end bar or crossbar into the one hole at the end of the strap and pulling on said pull device.

39. A strap restraint comprising a stem or body, a pull structure coupled to one end of said stem or body; an end bar or crossbar at the other end of said body or stem; and a first and a second strap wherein said end bar or cross bar extends transversely of said stem or body laterally through holes in the free tip end portions of respective ones of the two straps of the strap restraint for facilitating pulling of the straps to locked position about the wrists of a person being restrained.

40. A strap restraint comprising a stem or body, a pull structure coupled to one end of said stem or body; an end bar or crossbar at the other end of said body or stem of the strap restraint extending transversely of said stem or body and terminating in a semi-spherical end offset from a center axis of the bar or crossbar so that the bar or crossbar has a locking lip on an outer periphery of the semi-spherical end on a side of the bar or crossbar closest to the pull structure.

41. The strap restraint of claim 40 further comprising the bar or crossbar detachably connected to a strap with the semi-spherical end of the bar or crossbar extending through a hole in at least one end of the free tip end portion of the strap for facilitating pulling of the strap to a locked position around a person's wrist.

42. The strap restraint of claim 40 wherein the pull structure further comprises a ring structure for mounting the pull device on a carbineer or other loop attached to apparel worn by a user.

43. The strap restraint of claim 40 wherein the stem or body further comprises a living hinge that allows the pull structure to be folded perpendicular to the stem or body.

* * * * *